US010455916B2

(12) United States Patent
Moore

(10) Patent No.: US 10,455,916 B2
(45) Date of Patent: Oct. 29, 2019

(54) HAIR STYLING APPARATUS

(71) Applicant: Jemella Limited, Leeds (GB)

(72) Inventor: Timothy David Moore, Hertfordshire (GB)

(73) Assignee: Jemella Limited, Leeds (GB)

( * ) Notice: Subject to any disclaimer, the term of this patent is extended or adjusted under 35 U.S.C. 154(b) by 580 days.

(21) Appl. No.: 14/649,124

(22) PCT Filed: Nov. 20, 2013

(86) PCT No.: PCT/GB2013/053057
§ 371 (c)(1),
(2) Date: Jun. 2, 2015

(87) PCT Pub. No.: WO2014/087132
PCT Pub. Date: Jun. 12, 2014

(65) Prior Publication Data

US 2015/0313339 A1 Nov. 5, 2015

(30) Foreign Application Priority Data

Dec. 3, 2012 (GB) ..... 1221674.3

(51) Int. Cl.
*A45D 1/04* (2006.01)
*A45D 1/14* (2006.01)
(Continued)

(52) U.S. Cl.
CPC ..... *A45D 1/04* (2013.01); *A45D 1/14* (2013.01); *A45D 1/28* (2013.01); *A45D 2/001* (2013.01);
(Continued)

(58) Field of Classification Search
CPC ... A45D 1/04; A45D 1/14; A45D 1/28; A45D 20/08; A45D 20/30; A45D 2/001
(Continued)

(56) References Cited

U.S. PATENT DOCUMENTS 527,176 A 10/1894 Johnson
824,742 A 7/1906 Richardson
(Continued)

FOREIGN PATENT DOCUMENTS

CN 87213182 U 3/1988
CN 2503759 Y 8/2002
(Continued)

OTHER PUBLICATIONS

European Office Action for corresponding European Application 13 796 133.0 citing WO 02/21967A1; Report dated Aug. 18, 2016.
(Continued)

*Primary Examiner* — Joseph M Pelham
(74) *Attorney, Agent, or Firm* — Schwegman Lundberg & Woessner, P.A.

(57) ABSTRACT

This invention relates to apparatus and methods for regulating a parameter on a handheld appliance, such as a hair styling appliance. A hair styling apparatus comprises a body having at least one arm bearing a hair styling heater; a temperature sensor arranged to sense a temperature of the hair styling heater and generate a temperature sense signal; and a power supply unit comprising a magnetic energy transfer element, an AC input coupled to a first side of the magnetic energy transfer element, a heater drive output coupled to a second side of the magnetic energy transfer element and to the hair styling heater to power said hair styling heater, and a power controller configured to regulate the heater drive output. A power controller is coupled to the temperature sense signal and configured to regulate the heater drive output of the power supply so as to control the temperature of the hair styling heater responsive to the temperature sense signal.

24 Claims, 10 Drawing Sheets

(51) Int. Cl.

| | |
|---|---|
| ***A45D 1/28*** | (2006.01) |
| ***A45D 20/08*** | (2006.01) |
| ***A45D 20/30*** | (2006.01) |
| ***H05B 1/02*** | (2006.01) |
| ***A45D 2/00*** | (2006.01) |

(52) U.S. Cl.
CPC ..... *A45D 20/08* (2013.01); *A45D 20/30* (2013.01); *H05B 1/0252* (2013.01); *H05B 1/0255* (2013.01)

(58) Field of Classification Search
USPC ..... 219/222, 482, 448.12, 448.14; 132/211, 132/224
See application file for complete search history.

(56) References Cited

U.S. PATENT DOCUMENTS

| | | | | |
|---|---|---|---|---|
| 866,778 | A | | 9/1907 | Eldridge |
| 3,182,667 | A | | 5/1965 | Den |
| 3,927,684 | A | * | 12/1975 | Lam ..... A45D 20/48 132/119.1 |
| 4,196,343 | A | | 4/1980 | Han |
| 4,209,685 | A | * | 6/1980 | Walter ..... A45D 1/04 132/112 |
| 4,267,430 | A | | 5/1981 | Downey |
| 4,354,092 | A | | 10/1982 | Manabe et al. |
| 4,365,140 | A | | 12/1982 | Bast et al. |
| 4,408,282 | A | | 10/1983 | Hof |
| 4,424,437 | A | | 1/1984 | Walter |
| 4,553,343 | A | | 11/1985 | Primati |
| 4,757,183 | A | | 7/1988 | Karey et al. |
| 4,857,702 | A | | 8/1989 | Cafaro |
| 4,883,942 | A | | 11/1989 | Robak, Sr. et al. |
| 4,917,078 | A | | 4/1990 | Zaborowski |
| 4,953,266 | A | | 9/1990 | Trinkaus |
| 5,124,532 | A | | 6/1992 | Hafey et al. |
| 5,160,831 | A | | 11/1992 | Thaler et al. |
| 5,195,253 | A | | 3/1993 | Poumey et al. |
| 5,223,694 | A | | 6/1993 | Tsuji et al. |
| 5,243,683 | A | | 9/1993 | Yang |
| 5,345,055 | A | | 9/1994 | Leung |
| 5,394,620 | A | | 3/1995 | Chimera |
| 5,400,809 | A | | 3/1995 | Adams |
| 5,794,799 | A | | 8/1998 | Collins et al. |
| 5,857,262 | A | | 1/1999 | Bonnema et al. |
| 5,865,188 | A | | 2/1999 | Marquez |
| 5,938,957 | A | | 8/1999 | Tanahashi et al. |
| 5,952,812 | A | | 9/1999 | Maeda |
| 6,070,596 | A | | 6/2000 | Altamore |
| 6,119,702 | A | | 9/2000 | Habibi |
| 6,191,930 | B1 | | 2/2001 | Ramchandani |
| 6,199,295 | B1 | | 3/2001 | Smal |
| 6,314,236 | B1 | | 11/2001 | Taylor |
| 6,369,369 | B2 | | 4/2002 | Kochman et al. |
| 6,393,718 | B1 | | 5/2002 | Woodard |
| 6,449,870 | B1 | | 9/2002 | Perez et al. |
| 6,457,953 | B1 | | 10/2002 | Bradbury |
| 6,494,216 | B1 | | 12/2002 | Hirata |
| 6,627,852 | B1 | | 9/2003 | Savone |
| 6,703,587 | B2 | | 3/2004 | Sena et al. |
| 6,732,449 | B2 | | 5/2004 | Evanyk |
| D527,176 | S | | 8/2006 | Andre |
| 7,380,347 | B2 | | 6/2008 | Coates et al. |
| 7,445,012 | B2 | | 11/2008 | Mukai |
| 7,465,904 | B2 | | 12/2008 | Kim |
| 7,730,895 | B2 | | 6/2010 | Maddocks et al. |
| 7,748,391 | B2 | | 7/2010 | Vance |
| 7,783,177 | B2 | | 8/2010 | Ikesaki |
| 8,013,275 | B2 | | 9/2011 | Ng et al. |
| 8,232,761 | B1 | | 7/2012 | Thivierge et al. |
| 8,541,715 | B2 | | 9/2013 | Overend et al. |
| 8,544,476 | B1 | | 10/2013 | Marquardt |
| 8,567,414 | B2 | | 10/2013 | Rivola |
| 8,567,415 | B2 | | 10/2013 | Morgandi et al. |
| 8,776,805 | B2 | | 7/2014 | Degrood |
| 8,890,035 | B2 | | 11/2014 | Scheunert et al. |
| D719,296 | S | | 12/2014 | Brady et al. |
| 9,012,813 | B2 | | 4/2015 | Mourad |
| 9,474,347 | B2 | | 10/2016 | Pedorarena |
| 9,526,311 | B1 | | 12/2016 | Schaefer et al. |
| 9,698,767 | B2 | | 7/2017 | Tuttle |
| 2001/0014373 | A1 | | 8/2001 | Lin |
| 2002/0157276 | A1 | | 10/2002 | Mujica |
| 2002/0189128 | A1 | | 12/2002 | Nakagawa |
| 2003/0007872 | A1 | | 1/2003 | Bradbury |
| 2003/0089700 | A1 | | 5/2003 | Chang |
| 2004/0003824 | A1 | | 1/2004 | Habibi |
| 2004/0041684 | A1 | | 3/2004 | Mandell |
| 2005/0121050 | A1 | | 6/2005 | Cha |
| 2005/0224091 | A1 | | 10/2005 | Cafaro et al. |
| 2006/0081586 | A1 | | 4/2006 | Ramsay |
| 2006/0124922 | A1 | | 6/2006 | Kim et al. |
| 2006/0150996 | A1 | | 7/2006 | Lun et al. |
| 2006/0202852 | A1 | | 9/2006 | Peter et al. |
| 2007/0163614 | A1 | | 7/2007 | Ikesaki |
| 2007/0209673 | A1 | | 9/2007 | Choi |
| 2007/0220773 | A1 | | 9/2007 | Evanyk |
| 2007/0283529 | A1 | | 12/2007 | Hashizume |
| 2007/0283978 | A1 | | 12/2007 | Montagnino |
| 2008/0041409 | A1 | | 2/2008 | Leung |
| 2008/0053982 | A1 | | 3/2008 | Ceva |
| 2008/0087295 | A1 | | 4/2008 | Park |
| 2008/0092915 | A1 | | 4/2008 | Chan |
| 2008/0173322 | A1 | | 7/2008 | Leung |
| 2008/0216859 | A1 | | 9/2008 | Chan |
| 2008/0216860 | A1 | | 9/2008 | Legrain |
| 2008/0236604 | A1 | | 10/2008 | Mourad |
| 2008/0236609 | A1 | | 10/2008 | Wong |
| 2008/0240690 | A1 | | 10/2008 | Ono |
| 2008/0257372 | A1 | | 10/2008 | Mills et al. |
| 2008/0283080 | A1 | | 11/2008 | Habibi |
| 2009/0005723 | A1 | | 1/2009 | Shanks et al. |
| 2009/0032048 | A1 | | 2/2009 | Suzuki et al. |
| 2009/0044823 | A1 | | 2/2009 | Overend et al. |
| 2009/0114240 | A1 | | 5/2009 | Leung |
| 2009/0159093 | A1 | | 6/2009 | Yu |
| 2009/0293300 | A1 | | 12/2009 | Merritt |
| 2010/0083978 | A1 | | 4/2010 | Hottenrott |
| 2010/0101598 | A1 | | 4/2010 | Ng et al. |
| 2010/0132733 | A1 | | 6/2010 | Kyu et al. |
| 2010/0212683 | A1 | | 8/2010 | Mizuno |
| 2011/0017225 | A1 | | 1/2011 | Devulapalli |
| 2011/0056509 | A1 | | 3/2011 | Benest et al. |
| 2011/0079237 | A1 | | 4/2011 | Price |
| 2011/0091251 | A1 | | 4/2011 | Kim et al. |
| 2011/0226277 | A1 | | 9/2011 | Choi |
| 2012/0227758 | A1 | | 9/2012 | Ford et al. |
| 2012/0291797 | A1 | | 11/2012 | Degrood et al. |
| 2013/0239427 | A1 | | 9/2013 | Quessard |
| 2014/0130365 | A1 | | 5/2014 | Dineen |
| 2014/0338691 | A1 | | 11/2014 | Weatherly et al. |
| 2015/0122792 | A1 | | 5/2015 | Moore et al. |
| 2015/0136169 | A1 | | 5/2015 | Moore et al. |
| 2015/0313339 | A1 | | 11/2015 | Moore |
| 2016/0286928 | A1 | | 10/2016 | Weatherly et al. |

FOREIGN PATENT DOCUMENTS

| | | | |
|---|---|---|---|
| CN | 100858147 | B1 | 9/2008 |
| CN | 101262793 | A | 9/2008 |
| CN | 101810392 | A | 8/2010 |
| CN | 102045899 | A | 5/2011 |
| DE | 3115569 | A1 | 12/1982 |
| DE | 102010002795 | A1 | 9/2011 |
| EP | 2077343 | A1 | 8/2009 |
| EP | 2255692 | A1 | 1/2010 |
| EP | 1951082 | B1 | 10/2011 |
| EP | 2377419 | A1 | 10/2011 |
| GB | 235937 | | 6/1925 |
| GB | 573009 | | 11/1945 |
| GB | 1519930 | | 8/1978 |
| GB | 2016051 | A | 9/1979 |

(56) References Cited

FOREIGN PATENT DOCUMENTS

| | | | |
|---|---|---|---|
| GB | 2067097 | A | 7/1981 |
| GB | 2142817 | A | 1/1985 |
| GB | 2163574 | A | 2/1986 |
| GB | 2167946 | A | 6/1986 |
| GB | 2318544 | A | 4/1998 |
| GB | 2468176 | A | 9/2010 |
| GB | 2477834 | A | 8/2011 |
| GB | 2508590 | A | 6/2014 |
| JP | H08256818 | A | 10/1996 |
| JP | 2008104499 | A | 5/2008 |
| JP | 2010274050 | A | 12/2010 |
| KR | 20070083323 | A | 8/2007 |
| KR | 1020090005460 | A | 1/2009 |
| KR | 20090119155 | A | 11/2009 |
| KR | 20100041337 | A | 4/2010 |
| SU | 1567169 | A1 | 5/1990 |
| WO | 8000783 | A1 | 5/1980 |
| WO | 9603013 | A1 | 2/1996 |
| WO | 9610349 | A1 | 4/1996 |
| WO | 0111924 | A1 | 2/2001 |
| WO | 0221967 | A1 | 3/2002 |
| WO | 2004006712 | A1 | 1/2004 |
| WO | 2007043732 | A1 | 4/2007 |
| WO | 2007078048 | A1 | 7/2007 |
| WO | 2008064075 | A2 | 5/2008 |
| WO | 2009136739 | A2 | 11/2009 |
| WO | 2012028862 | A1 | 3/2012 |
| WO | 2012076885 | A2 | 6/2012 |

OTHER PUBLICATIONS

British Search Report for corresponding application GB1211231.4; Report dated Oct. 19, 2012.
British Search Report for corresponding application GB1212933.4 dated Feb. 21, 2013.
British Search Report for corresponding application GB1212933.4 dated Oct. 16, 2012.
British Search Report for corresponding application GB1214775.7; Report dated Apr. 18, 2013.
British Search Report for corresponding application GB1214775.7; Report dated Nov. 9, 2012.
Written Opinion for corresponding application PCT/GB2013/053057 filed Nov. 20, 2013; dated Mar. 18, 2014.
British Search Report for corresponding application GB1221671.9 dated Mar. 26, 2013.
British Search Report for corresponding application GB1221674.3; Report dated Mar. 19, 2013.
British Search Report for corresponding application GB1306648.5 dated Sep. 19, 2012.
International Preliminary Report on Patentability for corresponding application PCT/GB2013/051636 filed Jun. 21, 2013; Report dated Dec. 31, 2014.
International Preliminary Report on Patentability for corresponding application PCT/GB2013/051648 filed Jun. 24, 2013; Report dated Dec. 31, 2014.
International Search Report for corresponding application PCT/GB2013/051636 filed Jun. 21, 2013; dated Nov. 7, 2013.
International Search Report for corresponding application PCT/GB2013/051648 filed Jun. 24, 2013; dated Jan. 17, 2014.
International Search Report for corresponding application PCT/GB2013/052188 filed Aug. 19, 2013; dated Dec. 18, 2013.
International Search Report for corresponding application PCT/GB2013/053057 filed Nov. 20, 2013; dated Mar. 18, 2014.
J.A. Curran, "Thermo-physical properties of plasma electrolytic oxide coatings on aluminium", Surface & Coatings Technology 199 (2005) 168-176.
Written Opinion for corresponding application PCT/GB2013/051636 filed Jun. 21, 2013; dated Nov. 7, 2013.
Written Opinion for corresponding application PCT/GB2013/051648 filed Jun. 24, 2013; dated Jan. 17, 2014.
Written Opinion for corresponding application PCT/GB2013/052188 filed Aug. 19, 2013; dated Dec. 18, 2013.
"Australian Application Serial No. 2013353815, First Examiner Report dated Jan. 18, 2017", 4 pgs.
"Australian Application Serial No. 2013353815, Response filed Jun. 22, 2017 to First Examiner Report dated Jan. 18, 2017", 39 pgs.
"Chinese Application Serial No. 201380063028.3, Office Action dated Jul. 13, 2017", (w/ English Translation), 25 pgs.
"European Application Serial No. 13796133.0, Response filed Jan. 22, 2016 to Communication pursuant to Rules 161(1) and 162 EPC dated Jul. 14, 2015", 40 pgs.
"European Application Serial No. 13796133.0, Response filed Mar. 12, 2018 to Summons to Attend Oral Proceedings mailed Sep. 26, 2017", 94 pgs.
"European Application Serial No. 13796133.0, Response filed Dec. 19, 2016 to Office Action dated Aug. 18, 2016", 28 pgs.
"European Application Serial No. 13796133.0, Summons to Attend Oral Proceedings mailed Sep. 26, 2017", 8 pgs.
"International Application Serial No. PCT/GB2013/053057, International Preliminary Report on Patentability dated Jun. 18, 2015", 12 pgs.
"United Kingdom Application Serial No. 1221674.3, Amendment filed Feb. 20, 2014", 12 pgs.
"United Kingdom Application Serial No. 1221674.3, Examination Report dated Sep. 18, 2017", 4 pgs.
"United Kingdom Application Serial No. 1221674.3, Response filed Jan. 15, 2018 to Examination Report dated Sep. 18, 2017", 31 pgs.
"United Kingdom Application Serial No. 1720073.4, Combined Search and Examination Report dated Jan. 30, 2018", 7 pgs.
"Chinese Application Serial No. 201380063028.3, Office Action dated May 3, 2018", w/ English Translation, 33 pgs.
"Chinese Application Serial No. 201380063028.3, Office Action dated Aug. 7, 2018", w/ English translation, 21 pgs.

* cited by examiner

HAIR STYLING APPARATUS

FIELD OF THE INVENTION

This invention relates to apparatus and methods for powering hair styling apparatus, in particular to those for straightening and curling hair.

BACKGROUND TO THE INVENTION

There are a variety of apparatus available for styling hair. One form of apparatus is known as a straightener which employs plates that are heatable. To style, hair is clamped between the plates and heated above a transition temperature where it becomes mouldable. Depending on the type, thickness, condition and quantity of hair, the transition temperature may be in the range of 160-200° C. A hair styling apparatus can be employed to straighten, curl and/or crimp hair.

A hair styling apparatus for straightening hair is commonly referred to as a "straightening iron" or "hair straightener". FIG. 1 depicts an example of a typical hair straightener 1. The hair straightener 1 includes a first and second arms 4*a*, 4*b* each comprising a heatable plate 6*a*, 6*b* coupled to heaters (not shown) in thermal contact with the heatable plates. The heatable plates are substantially flat and are arranged on the inside surfaces of the arms in an opposing formation.

To use the styling apparatus to straighten hair, a squeezing force is applied to the arms so that they rotate about pivot 2 to clamp hair between the hot heatable plates. The hair is then pulled under tension through the plates so as to mould it into a straightened form. The hair straightener may also be used to curl hair by rotating the hair straightener 180° towards the head prior to pulling the hair through the hot heatable plates.

To power and control the heatable plates of FIG. 1, a mains power cable 8 is connected to a mains plug 10 to power the hair styling apparatus. Encased in the housing of the hair styling apparatus is a power supply circuit to convert the AC mains input to the appropriate drive voltage and a control circuit to control operation of the heaters and sense the temperature.

The fact that many electrical components are present in the hair styling apparatus means that the apparatus may become heavy to hold for an extended period of time. Furthermore design freedom can also be limited as component sizing imposes limitations on the shape and size of the hair styling apparatus. This invention seeks to address such issues by developing improvements to the power supply and control systems for such hair styling appliances.

SUMMARY OF THE INVENTION

According to a first aspect of the invention there is provided a hair styling apparatus comprising: a body having at least one arm bearing a hair styling heater; a temperature sensor arranged to sense a temperature of the hair styling heater and generate a temperature sense signal; and a power supply unit comprising a magnetic energy transfer element, an AC input coupled to a first side of the magnetic energy transfer element, a heater drive output coupled to a second side of the magnetic energy transfer element and to the hair styling heater to power said hair styling heater, and a power controller configured to regulate the heater drive output, wherein the power controller is coupled to the temperature sense signal; and wherein the power controller is configured to regulate the heater drive output of the power supply so as to control the temperature of the hair styling heater responsive to the temperature sense signal.

The temperature sense signal is fed back to the power supply unit such that the power controller is able to control the transfer of energy from the magnetic energy transfer element. In this way, the output of the magnetic energy transfer element, which powers the heater element, can then be regulated, thus controlling the temperature of the hair styling heater. The fact that the power supply unit output is controlled by the sensed temperature of the hair styling heater means that the output voltage, or current, may fluctuate, cycle between on and off, or progressively vary in order to regulate the temperature. Such regulation may be to ramp the temperature up to a desired operating temperature, retain the hair styling heater at the desired operating temperature and/or disable or throttle the power supply if the temperature increases above a desired operating temperature. More complex temperature control may also allow for the temperature to be ramped up fast during an initial heating phase, then as the temperature moves towards the desired operating temperature, reduce the voltage for example so that the targeted operating temperature is not 'overshot'.

In such a hair styling apparatus, the heater drive output may be a low voltage output for example, supplying a voltage of less than 100V. In some embodiments the hair styling heaters may be low voltage hair styling heaters requiring a drive voltage of, for example, 12 or 24V.

The magnetic energy transfer element in the power supply may be a transformer having a primary winding on the first side and a secondary winding on the second side. The primary winding of the transformer may then be coupled to the AC input, and the secondary winding may be coupled to the heater drive output and then to the hair styling heaters. In such an embodiment the power supply may then further comprise a primary side switch coupled to the primary winding. The power controller may then be configured to regulate the heater drive output, and thus the temperature of the hair styling heater, responsive to the temperature sense signal by controlling switching of the primary side switch coupled to the primary winding. In variants the magnetic energy transfer element may be an inductor.

Thus embodiments may be generally arranged to use a power supply in a switched mode power supply type arrangement, with the transformer providing galvanic isolation between the AC input and the heater drive output. The fact that a switched mode power supply type configuration is used means that the transformer may be considerably smaller than in a conventional linear power supply. This is because higher switching frequencies may typically be used to switch the primary side winding of the transformer.

The temperature sensor may be electrically insulated from the heater plate so as to isolate the temperature sense signal from the secondary side of the transformer.

The temperature sensor may monitor the temperature of the hair styling heater coupled to the secondary side of the transformer. However the signal may preferably be fed back to the primary side of the transformer such that the primary side switch can be controlled by the power controller in response to the sensed temperature. The temperature sensor, which may only be thermally coupled to the hair styling heater and not electrically coupled, may then remove the need for further galvanic isolation, such as by an opto-isolator for example. This reduces the component count of the power supply and hair styling apparatus further.

The power controller may be configured, for example, to regulate the heater drive output by adjusting the duty cycle of the primary side switch responsive to a change in the temperature sense signal. This may mean, for example, providing a 50% duty cycle to provide a maximum drive to the hair styling heater for rapid heat up, a reduced duty cycle to lower the output voltage to reduce the heat up (for example if the temperature has only reduced slightly), or a duty cycle of 0%, meaning that there is no output drive. In some embodiments the controller may adjust the duty cycle in multiple steps, for example 0%, 10%, 20%, 30%, 40%, 50%. In other variants the duty cycle may be controlled responsive to the temperature sense signal to be either 0% (off) and 50% such that the heater is not driven at all or driven.

The power controller may be configured to disable the heater drive output responsive to the temperature sense signal meeting or exceeding a reference voltage. This reference voltage may be set, for example, to correspond to a preferred operating temperature of the hair styling heater, ideally suited to provide optimum styling ability. The reference voltage may additionally (through the use of another or adjustable reference voltage) or alternatively be configured to correspond to a safety cut-off temperature, which, if exceeded, would deactivate the power supply. Deactivation may be, for example, setting the duty cycle to 0%, or deactivating another series switch so as to prevent any overheating of the hair styling apparatus.

In embodiments the power supply unit may be external to the body of the hair styling apparatus. In such an embodiment the power supply unit may be coupled to the body via an electrical cable so as to provide an electrical connection to the hair styling heater. Such a cable may be a multicore cable that may further provide a return path for the temperature sense signal from the temperature sensor to the power supply unit. One or more internal wires of the multicore cable may provide the return path. These may be separate from the one or more wires carrying power to the heater, for example for isolation. Alternatively a feedback signal may be carried by one or more wires carrying power to the heater, for example as a signal modulated into the power supply at the hair styler end of the link (and demodulated at the power supply end). This can reduce the number of wires used for the link.

By separating the power supply unit from the body of the hair styling apparatus, the body of the hair styling appliance may be reduced in weight and size, meaning that it may be easier to hold for a longer period of time. Furthermore, there is then an increased design freedom for such hair styling apparatus as the requirement to house many components of the power supply and/or heater control components is reduced. In some embodiments the body of the hair styling apparatus may then comprise a housing, one or more hair styling heaters, a temperature sensor, and electrical wires routed out to the external power supply. No, or minimal further components may then be present in the body.

The external power supply unit may comprise a power switch for turning the hair styling apparatus on and off. Such a switch may be arranged to be easily activated by foot, for example, such that a user can turn the styling apparatus on and/or off whilst holding the body of the hair styling apparatus. One or more further switches or dials may be present to set the temperature.

The hair styling apparatus may further comprise a second said arm bearing a second said hair styling heater; and a second said temperature sensor arranged to sense a temperature of the second said hair styling heater and generate a second said temperature sense signal, wherein the power supply unit further comprises a second heater drive output coupled to the secondary side of the magnetic energy transfer element to power the second hair styling heater; wherein the power controller is further coupled to the second temperature sense signal; and wherein the power controller is configured to regulate the output voltage of the second heater drive output of the power supply so as to control the temperature of the second hair styling heater responsive to the second temperature sense signal fed back from the second temperature sensor. The hair styling heaters in this embodiment may then be independently controllable.

The power controller may be configured to disable the or both heater drive outputs responsive to the temperature sense signal exceeding a threshold value. This may then be used to provide a safety cut-off feature.

In such an hair styling apparatus the hair styling heater may comprise a metal sheet or plate; an oxide layer comprising an oxide of said metal on a surface of said metal sheet or plate; and a heater electrode over said oxide layer, wherein the heater electrode is coupled to the heater drive output. Such a hair styling heater may be suitable for use with a low voltage heater drive output for example, such as 12V or 24V. Furthermore, the fact that the heater electrode may be provided on the oxide layer, which electrically insulates the heater electrode from the metal sheet or plate, means that a temperature sensor may be attached to the oxide layer so at to provide a strong thermal coupling to the metal sheet or plate. The or both temperature sensors may comprise, for example, a printed thermistor.

Many of the above features of the power supply unit may be incorporated into further aspects of the invention incorporating a power supply unit.

According to a second aspect of the invention there is provided a power supply unit for a hair styling apparatus, the hair styling apparatus comprising: a body having at least one arm bearing a hair styling heater; and a temperature sensor arranged to sense a temperature of the hair styling heater and generate a temperature sense signal, the power supply unit comprising: a magnetic energy transfer element; an AC input coupled to a first side of the magnetic energy transfer element; a heater drive output coupled to a second side of the magnetic energy transfer element for powering a said hair styling heater; a sense input to receive the temperature sense signal; and a power controller coupled to the sense input, wherein the power controller is configured to regulate the output voltage of the heater drive output so as to control the temperature of the hair styling heater responsive to the temperature sense signal.

Such a power supply unit is suitable for use in a hair styling apparatus according to the first aspect of the invention. Rather than having closed loop feedback from the output of the power supply to control the output voltage, and/or limit current, the power supply unit is configured to use a power controller configured to receive a temperature sense signal from a temperature sensor thermally coupled to a hair styling heater within the hair styling apparatus. This means that, rather than having two feedback loops: one within the power supply and another within a separate heater control unit to control heating, the two feedback loops are reduced to one. This way, the output of the power supply unit is regulated in response to the sensed temperature.

In embodiments, the hair styling heaters may be arranged to operate at below 100V, for example 12V or 24V, meaning that the heater drive output may be configured to supply a voltage of less than 100V, such as 12V or 24V.

As set out for the first aspect of the invention, in the power supply unit of the second aspect, the magnetic energy transfer element may comprise a transformer having a primary winding on the first side and a secondary winding on the second side, wherein the primary winding is coupled to AC input, and wherein the secondary winding is coupleable to the heater drive output; and a primary side switch coupled to the primary winding, wherein the power controller is configured to regulate the heater drive output responsive to the temperature sense signal by controlling switching of the primary side switch coupled to the primary winding.

In both the first and the second aspects of the invention the power supply unit may further comprise a rectifier circuit coupled between the AC input and the primary winding of the transformer to convert the AC input into a rectified power source.

As set out for the first aspect of the invention, the power controller may be configured to regulate the heater drive output by adjusting the duty cycle of the primary side switch responsive to a change in the received temperature sense signal.

According to a third aspect of the invention, there is provided a method of controlling the temperature of a hair styling heater in a hair styling apparatus, the hair styling apparatus comprising a body having at least one arm bearing a hair styling heater, and a power supply to power the hair styling heater; the power supply comprising a transformer having a primary winding and a secondary winding, an AC input coupled to the primary winding of the transformer, a heater drive output coupled to the secondary winding for powering the hair styling heater; and a primary side switch coupled to the primary winding, the method comprising: sensing a temperature of the hair styling heater; and controlling the switching of the primary side switch responsive to the sensed temperature to regulate the heater drive output of the power supply so at to control the temperature of the hair styling heater.

According to a fourth aspect of the invention there is provided a method of regulating the output of a power supply for a hair styling appliance, the hair styling apparatus comprising a body having at least one arm bearing a hair styling heater; the power supply comprising a transformer having a primary winding and a secondary winding, an AC input coupled to the primary winding of the transformer, a heater drive output coupled to the secondary winding for powering the hair styling heater; and a primary side switch coupled to the primary winding, the method comprising: sensing a temperature of the hair styling heater; and controlling the switching of the primary side switch responsive to the sensed temperature to regulate the heater drive output of the power supply.

According to a fifth aspect of the invention there is provided a hair styling apparatus comprising: a body having at least one arm bearing a hair styling heater, a temperature sensor arranged to sense a temperature of the hair styling heater and generate a temperature sense signal; a power supply unit external to the body, the power supply unit comprising an a magnetic energy transfer element, AC input coupled to one side of the magnetic energy transfer element to receive mains AC power, and an output coupled to a secondary side of the magnetic energy transfer element; and a heater controller coupled to the power supply output, the hair styling heater, and to the temperature sense signal, wherein the heater control circuit is configured to drive the hair styling heater responsive to the temperature sense signal, and wherein the heater controller circuit is located within the power supply unit external to the body of the hair styling apparatus.

In this aspect of the invention the heater controller circuit, which controls the activation and heating of the hair styling heater, may be located in the power supply unit external to the body of the hair styling apparatus. This reduces the component count in the body of the hair styling apparatus meaning that the weight of the hand-held body is reduced. Furthermore, the space required within the body to house the electrical components is reduced increasing the design freedom; the body and arms may be made slimmer for example.

The power supply unit may then be coupled to the body via an electrical cable, and the temperature sense signal may be routed from a temperature sensor thermally coupled to the hair styling heater to the heater control circuit via a return path or wire in the electrical cable. In other words, a multicore cable may be used to provide multiple electrical connections between the external power supply unit and the body of the hair styling apparatus.

In embodiments, the body of the hair styling apparatus may further comprise a second arm bearing a second hair styling heater. Such an embodiment may be arranged such that the hair styling heater and the second hair styling heater are connected in series, alternatively connected separately to the power supply unit. In the former case the temperature of the hair styling heaters may not be individually controllable as both are driven at the same time. In the latter case, each heater may be controlled separately, accordingly in such embodiments a second said temperature sensor may be arranged to sense a temperature of the second hair styling heater and generate a second temperature sense signal. The heater controller may then be further coupled to the second temperature sense signal and the heater control circuit may be configured to drive the second hair styling heater response to the second temperature sense signal.

In any of the above aspects of the invention where the temperature sense signal may be returned via a cable connecting the handheld stylers with an external unit, the temperature sense signal may be modulated onto one or more wires carrying power to the hair styling heaters. This reduces the number of wires (i.e. number of cores) needed within the cable connecting the power supply to the handheld stylers.

According to a sixth aspect of the invention there is provided a method of regulating a handheld appliance, the method comprising: providing a grid mains power supply for the appliance, to receive a mains input voltage and provide a reduced output voltage for powering the appliance; locating the power supply remotely from the appliance; connecting a cable between the power supply and the appliance to power the appliance from the output voltage of the power supply; sensing, at the appliance, a property of the appliance; feeding back, along the cable from the appliance to the power supply, a signal indicating the property of the appliance; and regulating the output voltage, at the power supply, in response to the signal.

According to a seventh aspect of the invention there is provided a handheld appliance and controller system comprising: a grid mains power supply for the appliance, to receive a mains input voltage and provide a reduced output voltage for powering the appliance, wherein the power supply is remote from the appliance; a cable between the power supply and the appliance to power the appliance from the output voltage; a sensor for sensing, at the appliance, a property of the appliance; and a feedback system to feed back, along the cable from the appliance to the power supply, a signal indicating the property of the appliance; and wherein the power supply is configured to regulate the output voltage in response to the fed back signal.

In the sixth and seventh aspects of the invention the power supply, coupleable to mains AC electricity, is housed remotely, i.e. externally, to the appliance or apparatus to reduce the weight of the handheld appliance. Furthermore, the fact that the component count in the handheld appliance is reduced means that there is more scope to vary the design, without the constraints of housing such components. The remote power supply is then coupled to the handheld appliance via a cable. A property of the appliance is sensed, at the appliance and then fed back along the connecting cable to the power supply allowing the output voltage of the power supply to be regulated in response to this parameter signal. This reduces the components count required in the handheld appliance as no local voltage adjustment is needed.

In embodiments of the sixth and seventh aspect the power supply may have a primary side to receive the mains input voltage and a secondary side to provide the reduce output voltage. The appliance may be a hair styling appliance. The property may be temperature. The regulating may comprise regulating at the primary side of the power supply.

Such hair styling apparatus may include hair straighteners, curlers, hair crimpers and hair dryers. Regulating at the primary side of the power supply may include, for example, controlling a switching rate and/or duty cycle of a primary side switch in a switched more power supply embodiment of the power supply.

The hair styling apparatus present in any of the preceding aspects of the invention may be hair straighteners or hair crimpers.

BRIEF DESCRIPTION OF THE DRAWINGS

For a better understanding of the invention and to show how it may be carried into effect reference shall now be made, by way of example only, to the accompanying drawings in which.

DETAILED DESCRIPTION OF PREFERRED EMBODIMENTS

Figure 1:
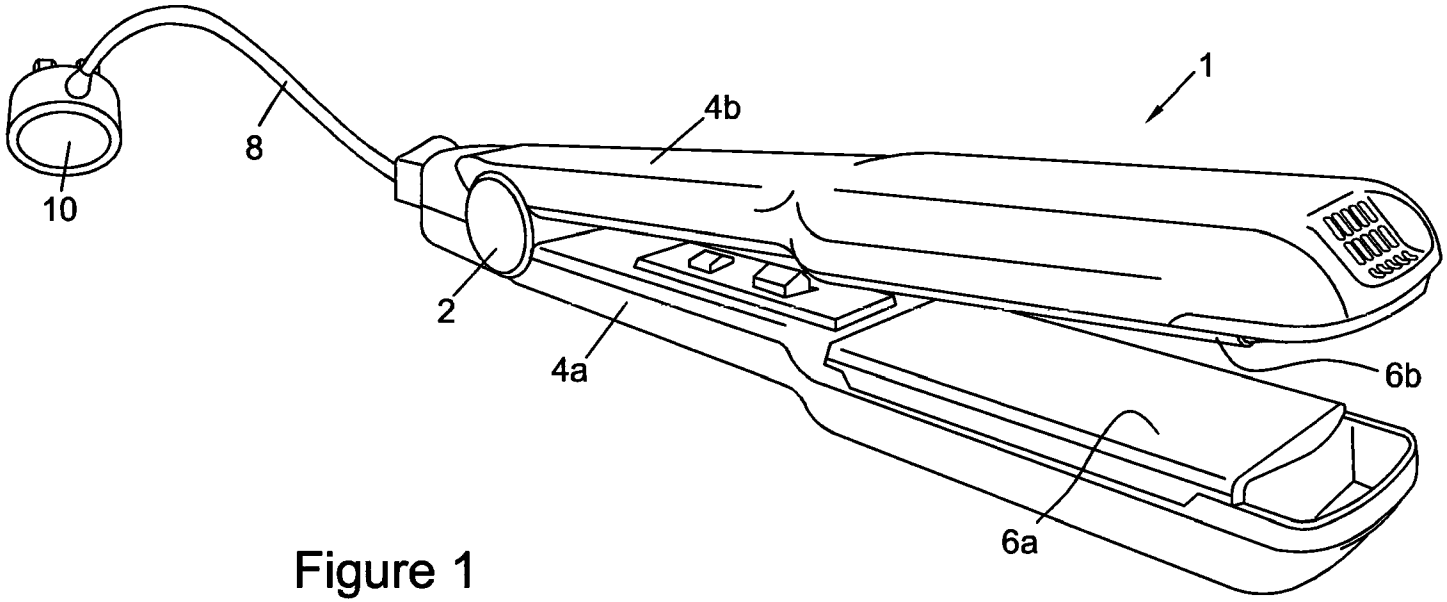
Figure 1 (prior art)
FIG. 1 shows an example hair styling apparatus for straightening hair according to the prior art.
Figure 2:
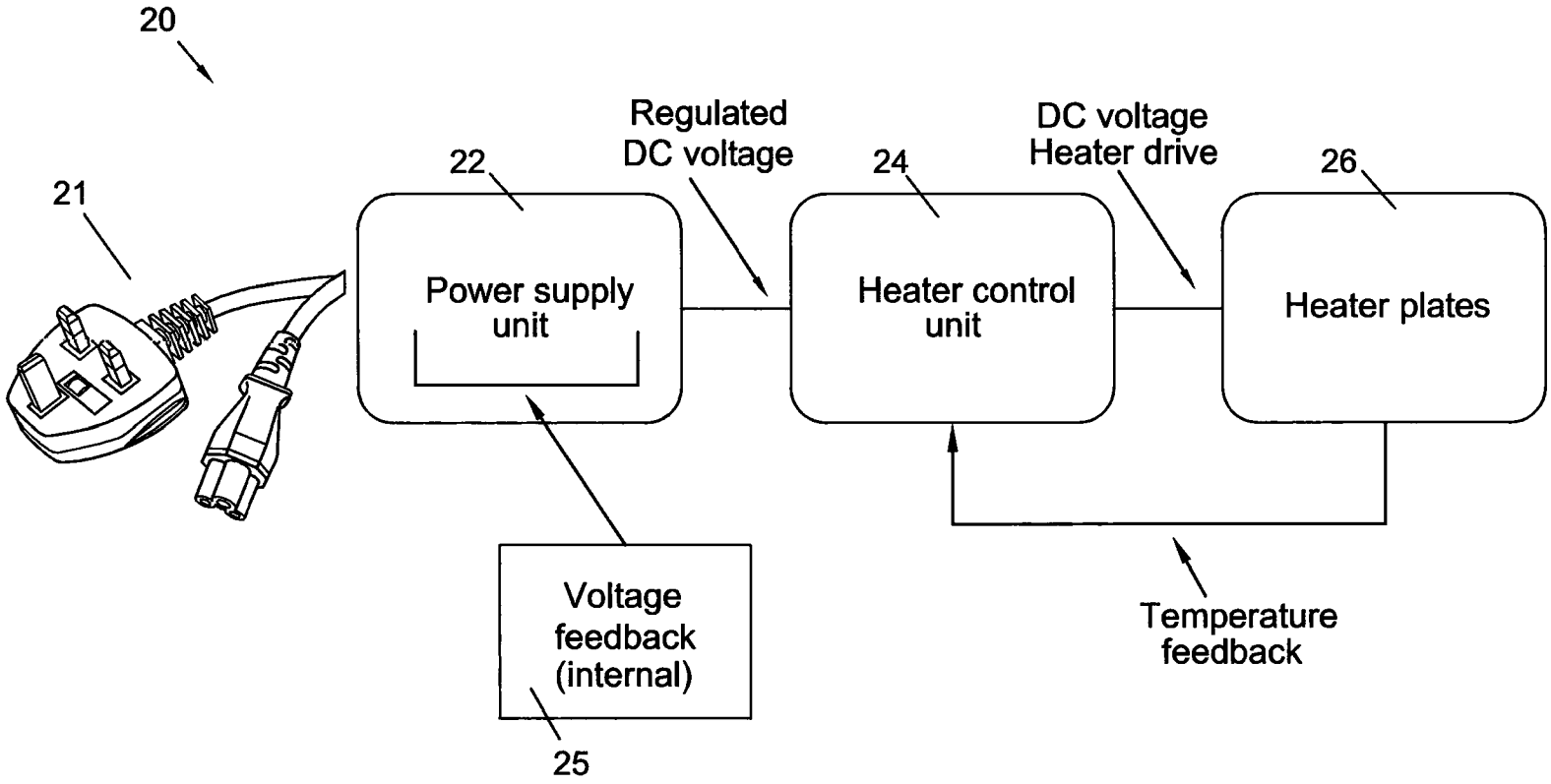
FIG. 2 shows an example of a power supply and heater control system for driving heater plates.

FIG. 2 shows an example of an electrical system 20 for a hair styling apparatus/appliance. A power supply circuit is formed from a power supply unit 22 with voltage feedback 25 to generate a regulated dc voltage. The controller, or heater control unit 25, controls delivery of a voltage, often DC, to the heater plates 26. The heater plate temperature is sensed by a temperature sensor, often a thermistor, or other form of temperature sensing device. A feedback loop from the temperature sensor to the heater control unit 24 is used to monitor and adjust power delivery to retain the temperature at a generally even temperature.

Figure 3:
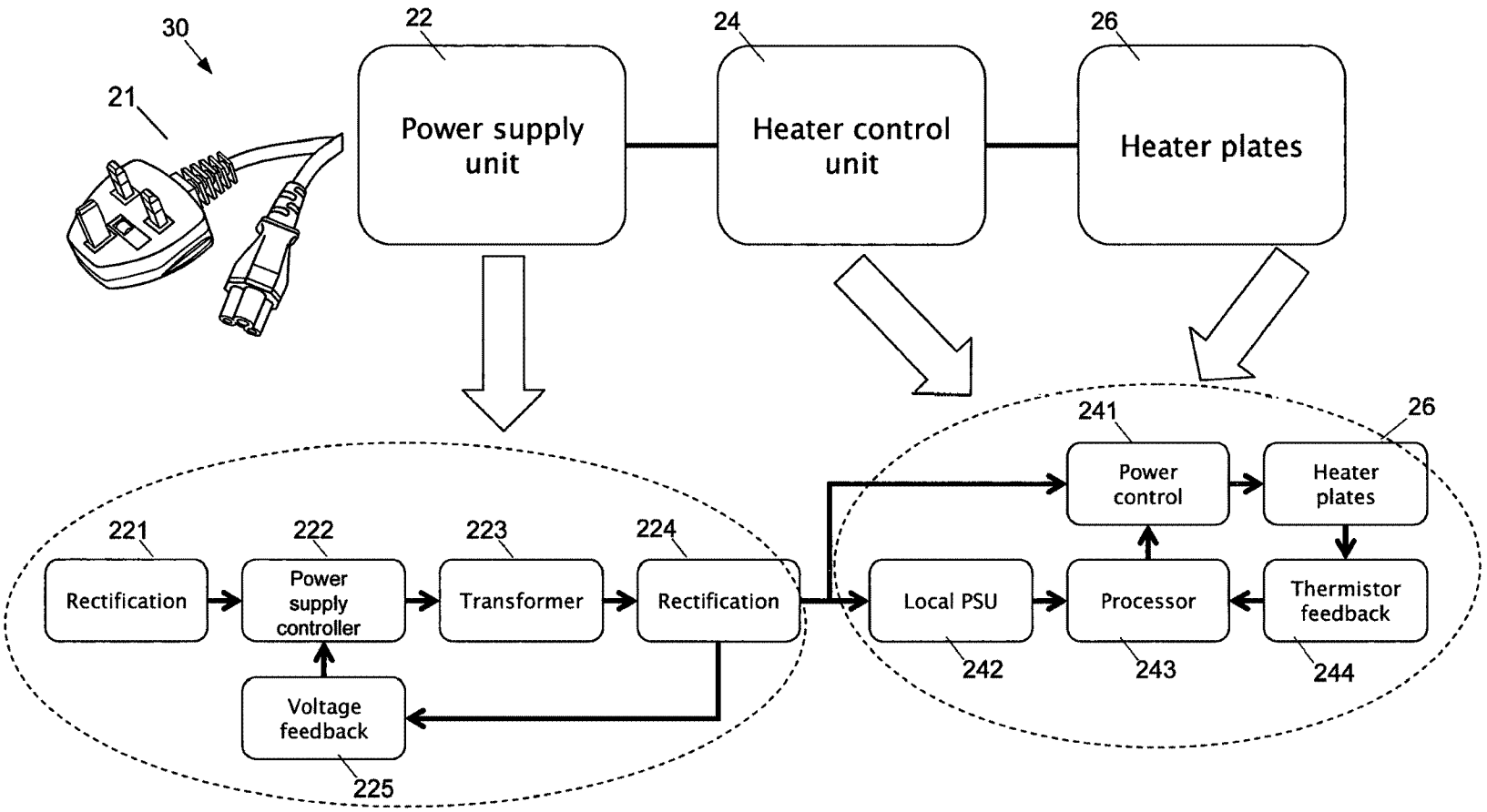
FIG. 3 shows further details of the power supply and heater control system of FIG. 2.

FIG. 3 shows further details of the components forming the power supply 22 and heater control unit system 24 of FIG. 2. The power supply unit 22 connects to a mains AC input 21. In the power supply unit 22, rectification module 221 converts the AC input waveform into one having a constant polarity. Typically a full wave rectifier may be used, using a four diode rectifier bridge for example. Power supply controller 222 controls switching of a power transistor on the primary side of transformer 223. A rectifier on the secondary side of transformer 223 converts the AC signal to an output DC voltage for powering components of the hair styling apparatus. The output voltage is fed back, typically via an opto-isolator, to the power supply controller 222 to regulate the voltage delivered to the heater control unit and heater plates.

A heater control unit 24 provides thermal control, controlling delivery of power to heaters for heating the heatable plates 26. The heater control unit is typically powered from the output DC voltage of the power supply, switching the heaters on and off according to heating requirements.

The heater control unit 24 incorporates a local power supply unit 242. This may, for example, provide a voltage converter/regulator to power the processor (converting from 12V to 5V for example).

A processing element 243, such as a microcontroller controls operation and in particular, power delivery to the heatable plates 26. The processing element may also be coupled to a user interface allowing different modes of operation to be set. The user interface may be one or more switches for example including a power switch and temperature/mode switch. The processing element may also be used to control user feedback, generating alerts or signals, visually via an indicator light or audibly via a speaker. This feedback may be used to indicate the status of the hair styling appliance to a user, such as indicating that the heatable plates are within a recommended temperature operating range, or reminding a user that the apparatus is on, and may need to be turned off.

Connected to and under control of the processing element 243, power control unit 241 controls delivery of power to the heatable plates 26. The power control unit switches the heatable plates on and off according to signals from the processing element 243.

A temperature sensor (e.g. a thermistor) 244 is thermally coupled to each heatable plate 26, sensing temperature and providing a temperature sense signal to the processing element. The processing element can then control operation of the heatable plates in response to the temperature feedback.

Figure 4:
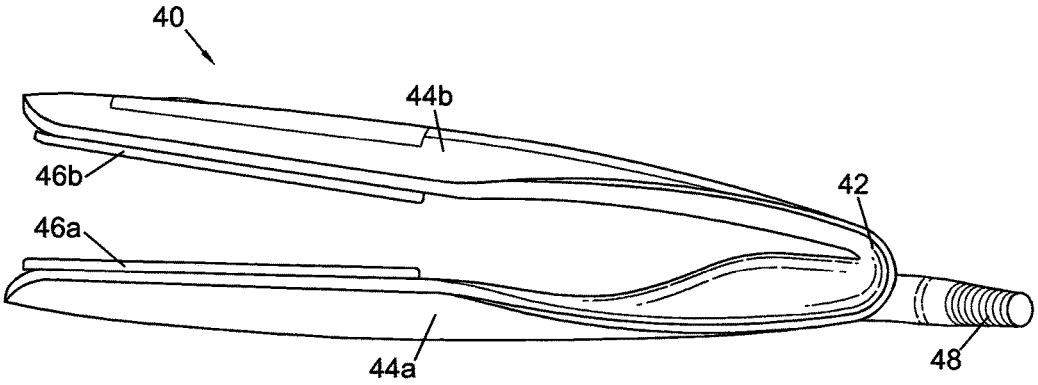
FIG. 4 shows an example embodiment of a hair straightener having a slimline housing.

FIG. 4 shows a side view of an illustrative embodiment of a hair styling apparatus 40 having a slimline housing. The styling apparatus is formed into a pair of hand-held styling tongs having two arms 44*a*, 44*b*, arranged so that when squeezed together the heatable plates 46*a*, 46*b* positioned on each arm 44*a*, 44*b* approach one another to allow hair to be clamped between. As can be seen in FIG. 4, the arms of the example embodiment are slimmer than many conventional hair straighteners, meaning that there is limited space to housing the power supply and heater control electronics.

Figure 5:
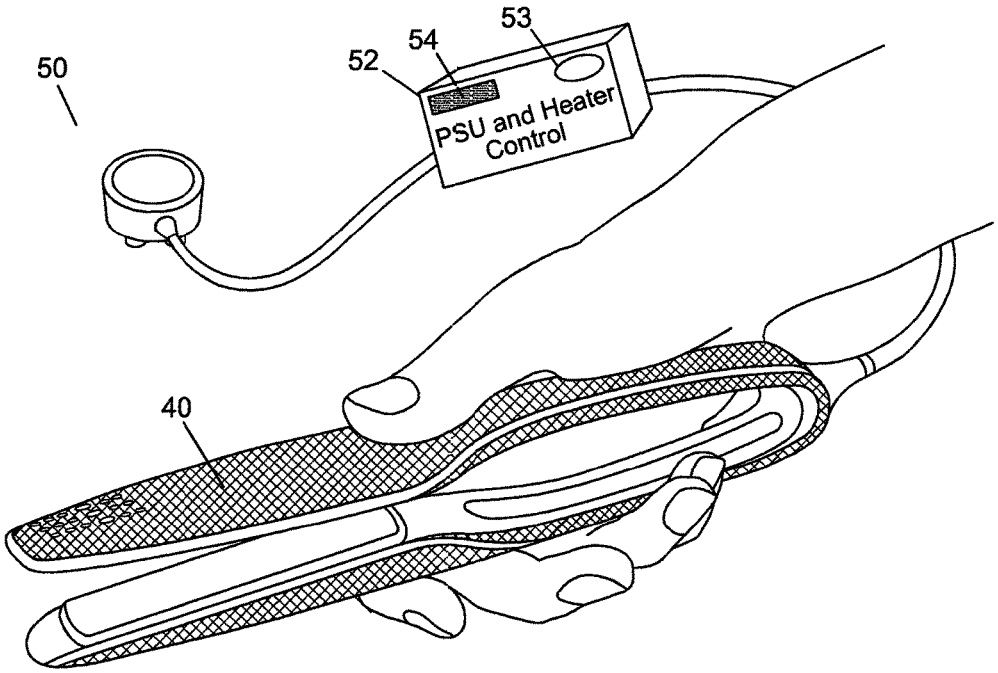
FIG. 5 shows the hair styling appliance of FIG. 4 with a separate power supply and control unit.

In FIG. 5, the hair styling apparatus is separated into two separate units: the hand-held styling tongs and an external unit 52. Components of the power supply and/or heater control electronics of the hair styling apparatus are now located in the external unit 52, remote to the hand-held styling tongs 40. This reduces the components in the hand-held styling tongs, reducing the space required and reducing the weight of the tongs. The external unit 52 connects to the mains AC input via a multi-core cable, then via another multi-core cable to the hand-held styling tongs. In use, the external unit would typically rest on the floor, connected via a cable of approximately two metres or more to the tongs. The external unit may incorporate a power switch 54 allowing a user to turn the hair styling appliance on or off. An LED indicator 53 may also be present to provide visual feedback that the apparatus is on. A temperature control switch or dial may also be present.

FIGS. 6-9 show further details of how the hair styling apparatus of FIG. 5 may be implemented.

The circuit arrangements shown in FIGS. 6-9 include example embodiments using low voltage heaters, capable of being driven by a voltage of below 100V, for example voltages 12-24V (although higher voltages, such as 36V, 50V or more may be used). The low voltage heaters may comprise an metal heater plate, such as an aluminium heater plate bearing a plasma electrolytic oxide (PEO) coating of aluminium oxide. A heater element, or track, may be screen printed on the surface of the PEO layer to form an electrode. A temperature sensing device, such as a thermistor, may then be fixed to the heater. The thermistor may be a printed or surface mounted device for example.

Figure 6:
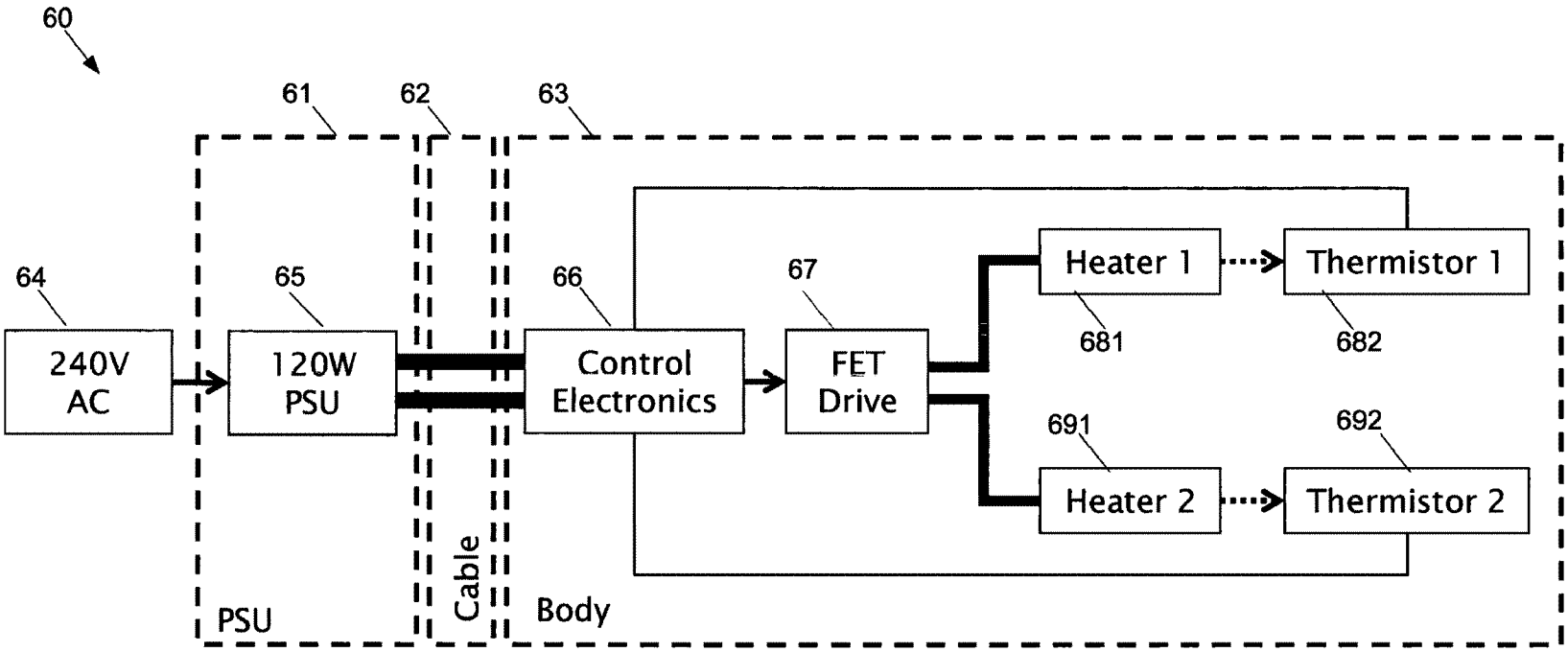
FIG. 6 shows a block diagram of a first embodiment of a hair styling appliance with a modified power supply and control system.

FIG. 6 shows a block diagram of a first embodiment 60 of a hair styling appliance with a modified power supply and control system. In this embodiment, the power supply 65 is housed in an external unit 61. The external power supply is capable of delivering 120 W at between 12V and 24V. The power supply output connects via a 2-core cable 62 to the hand-held tongs 63. The external power supply rectifies the AC input to provide a DC output the tongs. Operating at 12V, the 2-core cable is chosen to handle approximately 8-9 A.

In the embodiment of FIG. 6 the power supply is housed externally, with the components for controlling the heaters are housed in the body on of the tongs. In the hand-held tongs, the heater controller/control electronics 66 drive a power controller and transistor 67 which in turn switches in a current to the heaters 681, 691 to heat the heatable plates. A thermistor 682, 692 on each heater plate allows the temperature of each heater plate to be monitored independently. Independent control of each heater may then be possible.

One advantage of this arrangement is that the cable connecting the external unit to the hand-held tongs only requires two cores, meaning that the cable assembly is both low cost and also lightweight.

Figure 7:
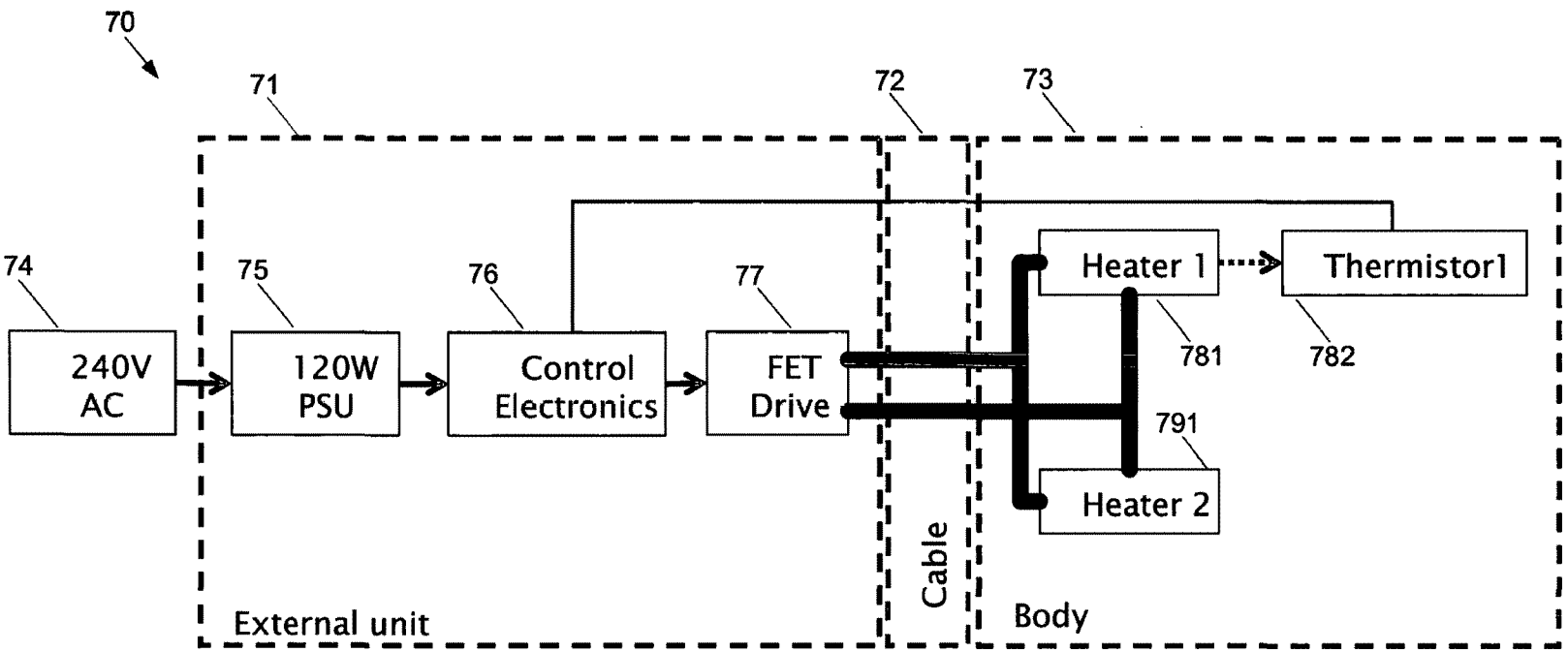
FIG. 7 shows a block diagram of a second embodiment of a hair styling appliance with a modified power supply and control system.

FIG. 7 shows a block diagram of a second embodiment of a hair styling appliance with a modified power supply and control system. In this embodiment, the power supply 75 is housed in an external unit 71 along with the heater controller/control electronics 76 and power transistor drive 77 for driving the heaters. The external power and control unit is connected to the hand-held tongs 73 by a four-core cable. Two cable cores provide power to the heaters 781, 791, and another two cores are connected to a thermistor 782 for sensing the temperature of heater 781.

In the hand-held tongs, the two heaters 781, 791 are connected in parallel, with the thermistor 782 mounted to one of the heater/heatable plate assemblies. Both heaters are controlled together. One advantage of this arrangement is that there is a reduction in components in the hand-held tongs, with power supply and control components moved into the external unit. Furthermore, only a four-core cable is required, meaning that the cable is still relatively lightweight and low cost.

In the embodiment shown in FIG. 7, the power supply typically generates an output of approximately 12V to drive the parallel connected heaters. In a variant, the heaters may be connected in series, with the power supply generating an output of around 24V. In this way, the current requirement would be halved meaning that thinner gauge cable cores may be used to power the heaters.

Figure 8:
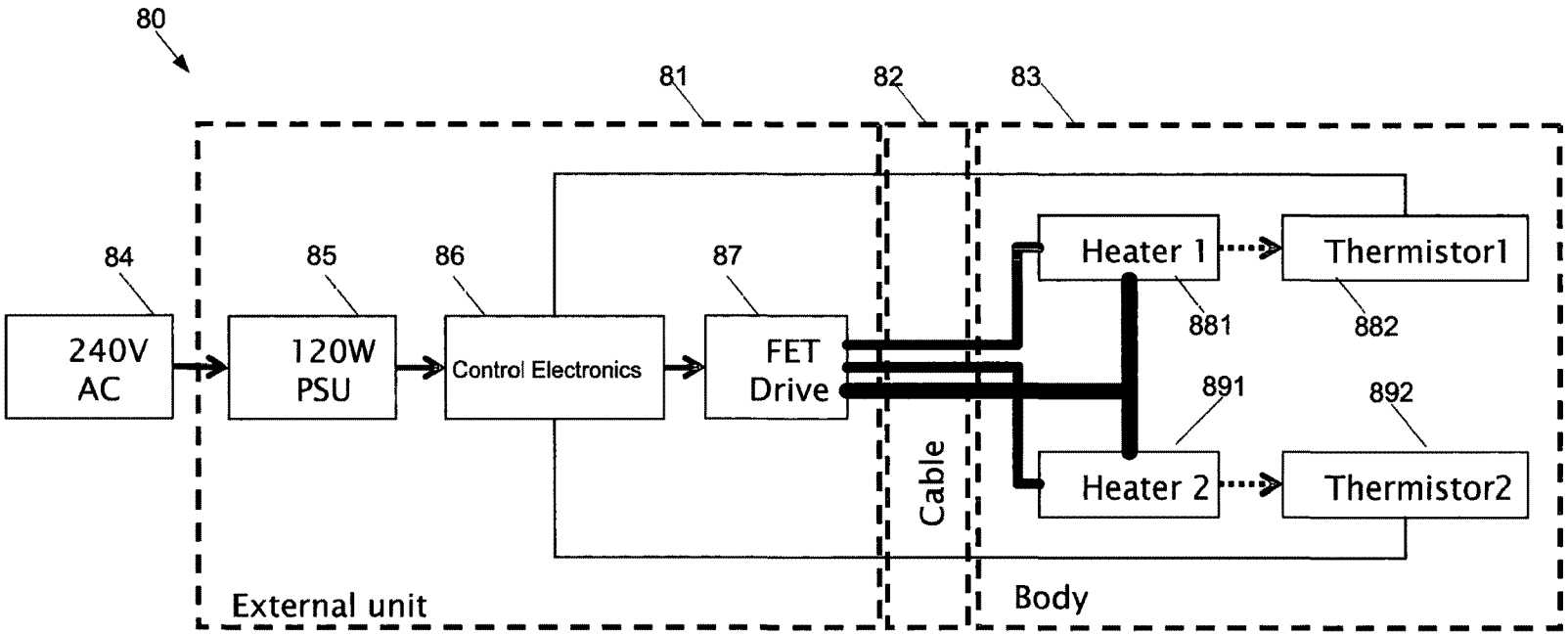
FIG. 8 shows a block diagram of a third embodiment of a hair styling appliance with a modified power supply and control system.

Turning now to FIG. 8, this shows a variant of the FIG. 7 embodiment. In this embodiment, the power supply 85 is also housed in an external unit 81 with the heater controller/control electronics 86 and power transistor drive 87 for driving the heaters. This embodiment differs to FIG. 7 by providing independent sensing and control of each heater 881,891. Two thermistors 882, 892, one for each heater plate, sense the temperature of each heater plate in the hand-held tongs. The temperature sense signals from each thermistor are fed back to the control electronics in the external unit.

In the embodiment in FIG. 8 a six-core cable 82 is used. Three cores provide power to the heaters, one of which provides a switched drive signal for one heater, another provides a switched drive signal for the other heater, and the third provides a shared return path. The further three cores are used for the thermistors, with one shared wire, and the remaining two each connected to a different one of the thermistors to provide separate temperature sense signals. Each thermistor may then be used in one of the many known thermistor circuits, such as a bridge circuit for example, allowing the sense signal from each thermistor to be used to determine the temperature of the heater plate on which the thermistor is positioned.

In the embodiments shown in FIGS. 7 and 8, the resulting hand-held tongs may comprise of a body with two arms, each bearing a hair styling heater, and so may be lightweight. With the power supply and heater control housed externally, embodiments are permitted that comprise only electrical wires providing a connection between the external power supply and the heaters within the body of the hand-held tongs.

Figure 9A:
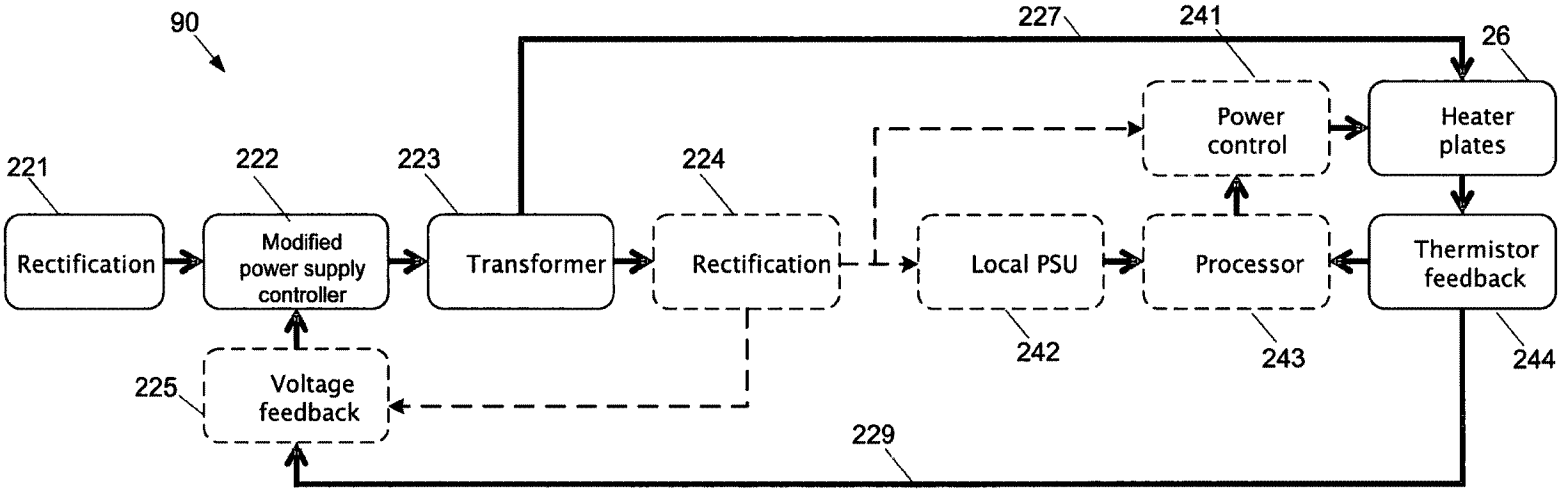
FIG. 9*a* provides a comparison of the modified power supply and control system with that of FIG. 3.
Figure 9B:
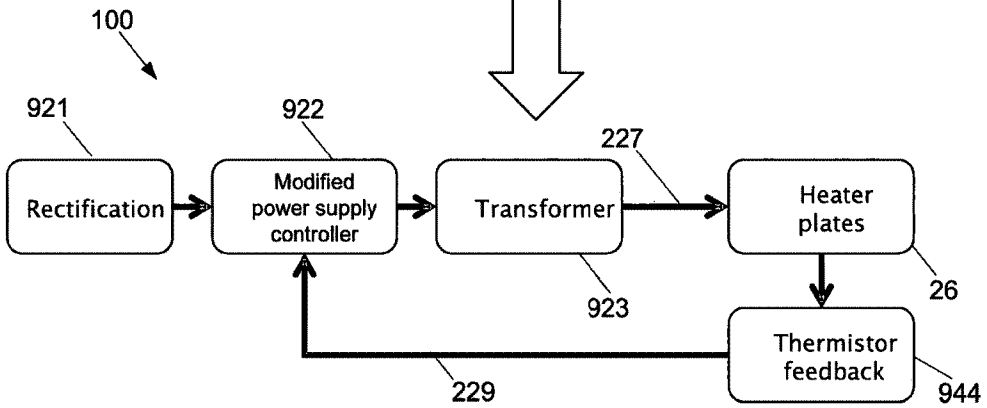
FIG. 9*b* shows further details of the power supply and control system for use in a hair styling appliance.

As explained previously with reference to FIG. 3, in conventional styling apparatus the power supply module 22 may incorporate a feedback loop to control and adjust the voltage output of the power supply under different loads. The heater control unit may further include a feedback loop from the thermistor back to the processing element to sense and adjust power being delivered to the heater plates. FIGS. 9*a* and 9*b* show one way of combining the separate power supply and heater control module to achieve a more compact design.

FIG. 9*a* shows a modified version of the power supply and control modules shown in FIG. 3. In FIG. 9*a*, the secondary side of the transformer 223 is connected to the heater plates 26, rather than to the separate heater control unit. Modules that may now be removed are shown in dotted lines on FIG. 9*a*. The two feedback loops are now replaced by a feedback loop 229 from the temperature sensor to a modified power supply controller 222. A further feedback loop may be provided from each temperature sensor to the modified power controller.

The removal of several modules means that the more compact circuit of FIG. 9*b* is formed. As shown in FIG. 9*a*, modules such as rectification and voltage feedback in the power supply may no longer be needed, as well as the local PSU, processing element and power control modules in the heater control unit. Heater control functionality may now be incorporated into the modified power controller.

Shown in FIG. 9*b*, the secondary side of the transformer now feeds the heater elements in the heater plates via connection 227. No rectification is required, but may be provided in some embodiments if it is preferred to drive the heater elements/heater plates with a DC power source.

The temperature sensor feeds a temperature sense signal 229 to the modified power controller 922. The power controller is accordingly reconfigured to control the output voltage on the secondary side in response to the sensed temperature, i.e. the output voltage on the secondary side of the transformer winding is now dependent upon the sensed temperature. This eliminates the need for a separate heater control to separately provide thermal control of the heaters. This way, the power supply is regulated by means of the temperature sense signal, rather than monitoring the output voltage.

As the skilled person will appreciate, galvanic isolation is typically a requirement in such systems to provide electrical isolation from the mains electricity. In the modified electronics of FIG. 9*b* the temperature sensor may be coupled to the modified power supply controller 922 on the primary side of transformer 923 and inherently isolated from the secondary side of the transformer as there is no electrically conductive connection to the heater plates—only a thermal connection. In this way, no opto-isolator may be needed.

Figure 9C:
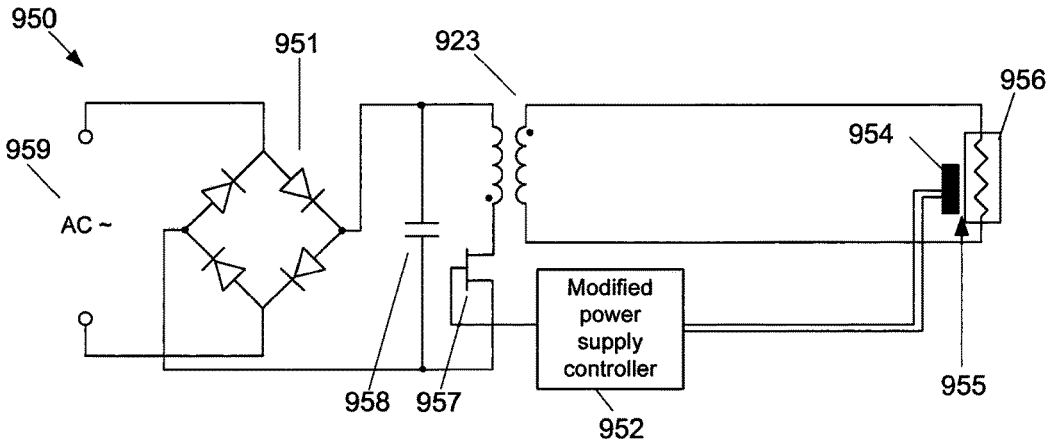

FIG. 9*c* shows an illustrative schematic of a switched mode power supply (SMPS) for a hair styling apparatus. The SMPS in this illustrative embodiment is in a flyback configuration with control electronics using temperature sense feedback. In variants it will be appreciated that other SMPS configurations may be used, such as a forward converter or full forward converter, again with temperature sense feedback from a temperature sensor sensing a temperature of a hair styling heater. An AC mains input 959 is coupled to rectifier circuit 951. Reservoir capacitor 958 is connected across the primary side of the transformer 923 and switching transistor 957. The secondary side of the transformer 923 is then coupled to the heater element 956 in a heater plate.

Feedback is provided by a temperature sensor 954 which feeds a temperature sense signal to the modified power supply controller 952 on the primary side of the transformer.

In many conventional power supply systems a feedback signal is provided from the output voltage signal. To retain the isolation between primary and secondary sides of the transformer 923, isolation means, such as an opto-isolator may be used. However in the embodiment of FIG. 9*c* the temperature sensor itself is electrically isolated from the secondary side circuit of the combined power supply and heater circuit as indicated by arrow 955 in FIG. 9*c*. This means that no further isolation may be necessary as the temperature sensor may be inherently isolated from the secondary side of the transformer.

This temperature sense signal may then be used to control the duty cycle of the switching transistor 957 responsive to the sensed temperature so as to adjust the output (e.g. voltage) on the secondary side of the transformer and accordingly the power to the heater element.

Increasing the duty cycle, i.e. turning the transistor switch on for a longer percentage of the switching period may then lead to an increased output voltage. Conversely, reducing the duty cycle may then lead to a reduced output voltage. Optionally, smoothing/rectifying components may be added to the secondary side of the transformer, including a diode and output smoothing capacitor, although it will be appreciated that for driving a heating element these may not be essential.

The temperature sensor provides feedback to the modified power supply controller. The controller may then, for example, compare the sensed signal with a reference voltage for the normal operating temperature.

Rather than controlling the output to provide a constant voltage, the controller, now dependent on a temperature sense signal, may be configured to control the output to provide a constant output temperature, or adjust as necessary. This may lead, for example, to the voltage on the secondary side varying, or limiting the current drive.

In another embodiment, the output may be controlled to switch between powering the heater, i.e. drive (on), and not driving the heater, i.e. no-drive (off), enabling the output to drive the heater only when the temperature is below a desired operating temperature. In such an embodiment, in periods when the heater plates are being driven the secondary side voltage may be, for example, 12V. In periods when the heater plates do not need to be driven, the secondary side may not be driven, i.e. 0V. In such an embodiment, if the sensed value is below a reference value for the normal operating temperature, the resulting signal from a comparison of the reference value and sensed value may be used as an indicator that the secondary side now needs to be driven, i.e. the comparison signal may be considered a 'call for heat' signal. When the desired operating temperature is reached, then the 'call for heat' is disabled meaning that the secondary side no longer needs to be driven.

In an SMPS the duty cycle of the switching transistor 957 may be controlled dependent on the temperature sense signal to either increase or decrease the secondary side voltage and thus the voltage delivered to the heating element. In variants, the switching frequency may also be controlled.

The controller may be further configured to limit the maximum current transferred from the primary side to the secondary side of the transformer.

In the event that the sensed temperature becomes excessive, the modified power supply controller may completely disable the switching transistor such that no power is transferred to the second side at all, meaning that the heaters are promptly turned off.

The modified controller may also incorporate additional features, such as a temperature control. This optional temperature control may allow a user to adjust a temperature of the hair styling heater(s) and may be located at the power supply and/or appliance end of the link, for example to adjust the temperature by modifying the temperature sense signal and/or the response (of the power supply) to the signal. The modified power supply controller may incorporate such functionality.

It will be appreciated that the schematic in FIG. 9*c* is an illustrative example only and further components may well be included—the intention is to show feedback from the temperature sensor, providing inherent galvanic isolation in the feedback loop, sensing the temperature of the heater plates to the modified power supply controller.

In the embodiment of FIG. 9*c* a thermistor is used, however it will be appreciated that there are many other forms of temperature sensor that may be used to detect a change in temperature, including thermocouples, resistive elements, and shape memory materials such as bi-metallic strips. In the latter case, a shape memory material may be used, for example, to detect that a temperature threshold has been crossed, activating or deactivating one or switches to generate one or more temperature sense signals to feedback to the modified power supply controller.

The resulting combined power and control module has a reduced component count compared to the conventional separate power supply and heater control modules, with feedback from the heater plate temperature sensor (a thermistor in the embodiments shown) back to the power controller. Thus, the voltage delivered by the power conversion is controlled dependent on the sensed temperature feedback.

In other embodiments, additional temperature sense signals may be fed back from additional temperature sensors monitoring other heating plate and/or monitoring other zones on the same heating plate. The latter enables a heating plate on one arm to be divided into multiply independent and controllable heating zones, either along the length or across the width of the heating plate.

Figure 10A:
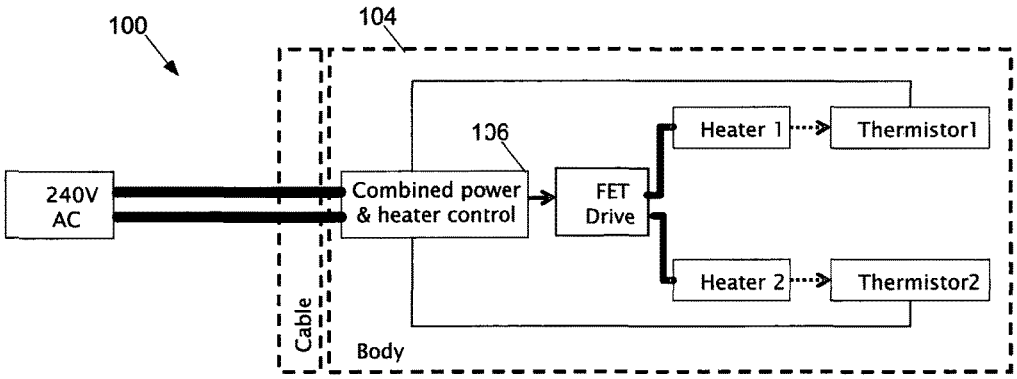
FIGS. 10*a-c* shows three variants of the hair styling apparatus incorporating the combined power and control module.
Figure 10B:
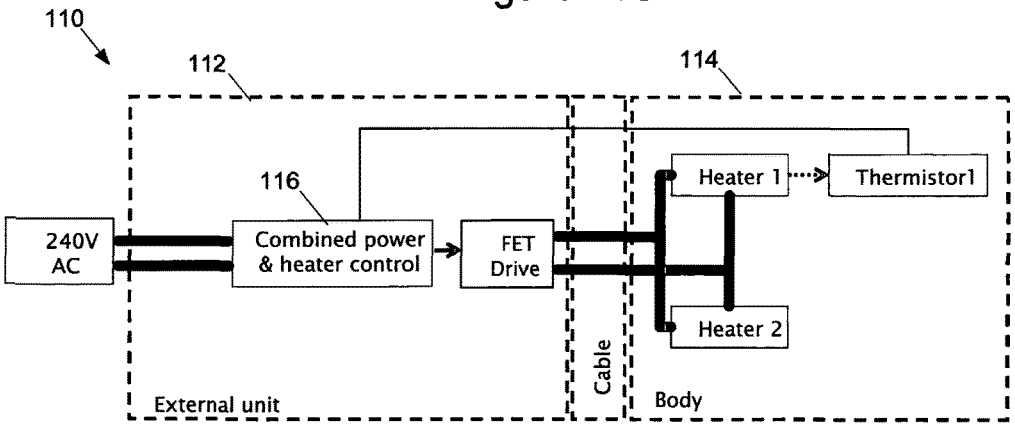
Figure 10C:
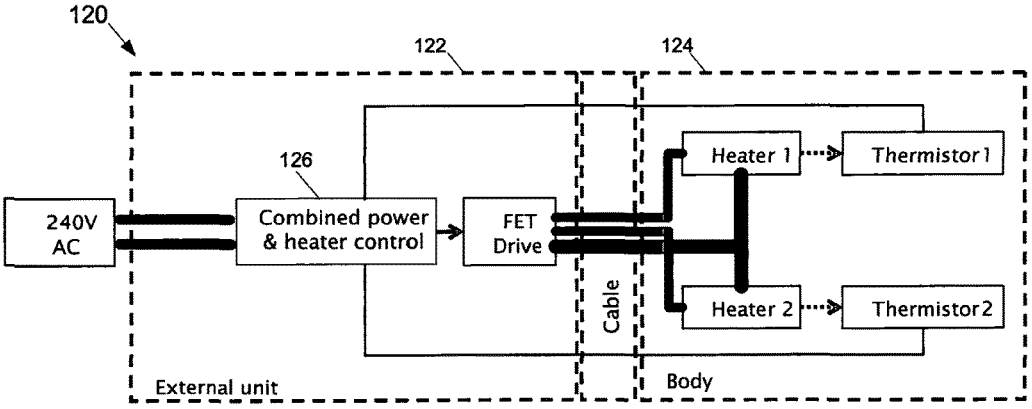

FIGS. 10*a-c* show three variants of the hair styling apparatus incorporating the combined power and control module of FIG. 9*b*. In all three variants the temperature sensor may provide the inherent galvanic isolation in the feedback loop between the primary and secondary sides of the transformer.

FIG. 10*a* shows a modified version of the styling apparatus in FIG. 6, with an embodiment 100 of the hair styling apparatus housing the combined power supply and heater control module 106 in the hand-held housing 104 of the styling apparatus. In FIG. 10*a*, the styling apparatus is connected to a mains AC connection via a conventional two-core cable (or three-core if a ground connection is required) without use of an external unit to house any power supply or heater control components. However, the use of the combined power and heater control module, with feedback from the temperature sensor to the power supply switching control means that the component count is reduced, the weight is reduced, and the space required to house the electronics is reduced compared to a hair styling apparatus implementing a conventional power supply and control system.

FIG. 10*b* shows a modified version of the styling apparatus of FIG. 7, with an embodiment 110 of the hair styling apparatus housing the combined power and control module in an external unit 112. In this embodiment the thermistor senses the temperature of one heating plate, which is then fed back to the combined power and control module to control the drive voltage to both heating plates.

FIG. 10*c* shows a modified version of the styling apparatus of FIG. 8, with an embodiment 120 of the hair styling apparatus housing the combined power and control module in an external unit 122. In this embodiment one thermistor is used to sense the temperature of each heating plate, with both sense signal fed back to the external unit 122 housing the combined power and control unit 126. Each heater may then be controlled independently.

In the embodiments shown in FIGS. 10*b* and 10*c*, as with the embodiments shown in FIGS. 7 and 8, the resulting hand-held tongs may comprise a body with two arms, each bearing a hair styling heater, and so may be lightweight. With the power supply and heater control housed externally, embodiments are permitted that comprise only electrical wires providing a connection between the external power supply and the heaters within the body of the hand-held tongs. Furthermore, in the embodiments in 10*b* and 10*c*, the size and weight of the external power supply unit may be significantly reduced over the embodiments shown in FIGS. 7 and 9 owing to the reduction in component count by way of feeding back the temperature sense signal to the power controller.

In the previously described embodiments that incorporate the heater control into the external housing, for example as shown in FIGS. 7, 8, 10*c* and 10*c* the return path from the temperature sensor may be provided as one or more wires separate to those powering the hair styling heaters, for example for isolation. Alternatively a feedback signal may be carried by one or more wires carrying power to the heater, for example as a signal modulated into the power supply at the hand-held tongs end of the link (and demodulated at the power supply end). This can reduce the number of wires used for the link, meaning that, for example, a four or six core wire may be reduced to a two core cable to provide power to the handheld tongs and modulated feedback on the same wires.

In variants of the embodiments shown in FIGS. 10*a*-10*c* incorporating the circuit of FIG. 9*b*, further functionality may be added to provide a user interface, enabling user control of the heater plate temperatures, visual and audio feedback, and also to provide calibration capabilities for the temperature sensors uses. In some variants such functionality may be incorporated into the combined power and control module, in others a separate processing element (microcontroller, PIC or the like) may be used. Should any features be incorporated into the handheld tongs, signals back to the external unit may again be returned in similar ways to the temperature sense feedback.

No doubt many other effective alternatives will occur to the skilled person. It will be understood that the invention is not limited to the described embodiments and encompasses modifications apparent to those skilled in the art lying within the spirit and scope of the claims appended hereto.

Through out the description and claims of this specification, the words "comprise" and "contain" and variations of the words, for example "comprising" and "comprise", means "including but not limited to, and is not intended to (and does not) exclude other moieties, additives, components, integers or steps.

Throughout the description and claims, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example, of the invention are to be understood to be applicable to any other aspect, embodiment or example described herein unless incompatible therewith.

The invention claimed is:

1. A hair styling apparatus comprising a body having at least one arm bearing a hair styling heater for heating hair to be styled;

a temperature sensor arranged to sense a temperature of the hair styling heater and to generate an electrical temperature sense signal that depends on the sensed temperature of the hair styling heater; and a power supply unit comprising a transformer having a primary winding on a first side and a secondary winding on a second side, an AC input and a primary side switch coupled to the first side of the transformer, a heater drive output coupled to the second side of the transformer element and to the hair styling heater to power said hair styling heater, and a power controller configured to regulate the heater drive output by controlling an input to the first side of the transformer element, wherein the power controller is coupled to the temperature sense signal; and wherein the power controller is configured to regulate the heater drive output of the power supply in multiple steps by adjusting a duty cycle of the primary side switch so as to control the temperature of the hair styling heater responsive to the temperature sense signal.

2. The hair styling apparatus as claimed in claim 1, wherein the heater drive output is a low voltage output to supply a voltage of less than 100V.

3. The hair styling apparatus as claimed claim 2, wherein the power supply unit is configured to provide a maximum heater drive output voltage of 24V or 12V.

4. The hair styling apparatus as claimed in claim 1, further comprising:

a second said arm bearing a second said hair styling heater; and a second said temperature sensor arranged to sense a temperature of the second said hair styling heater and generate a second said temperature sense signal, wherein the power supply unit further comprises a second heater drive output coupled to the secondary side of the transformer to power the second hair styling heater;

wherein the power controller is further coupled to the second temperature sense signal; and wherein the power controller is configured to regulate the output voltage of the second heater drive output of the power supply so as to control the temperature of the second hair styling heater responsive to the second temperature sense signal fed back from the second temperature sensor.

5. The hair styling apparatus as claimed in claim 1, wherein the power controller is configured to disable the heater drive outputs responsive to the temperature sense signal exceeding a threshold value.

6. The hair styling apparatus as claimed in claim 1, wherein the hair styling apparatus is a hair straightener or hair crimper.

7. The method of controlling the temperature of the hair styling heater of the hair styling apparatus of claim 1, the method comprising:

sensing a temperature of the hair styling heater and generating an electrical temperature sense signal that depends on the sensed temperature of the hair styling heater; and controlling the switching of a primary side switch coupled to the first side of the transformer responsive to the temperature sense signal to regulate the heater drive output of the power supply unit so as to control the temperature of the hair styling heater.

8. The method as claimed in claim 7, comprising insulating the temperature sensor from a heater plate of the hair styling heater so as to isolate the temperature sense signal from the secondary side of the transformer.

9. The method as claimed claim 7, wherein the controlling disables the heater drive output responsive to the temperature sense signal meeting or exceeding a reference voltage.

10. The method as claimed in claim 7, wherein the power supply is external to the body of the hair styling apparatus.

11. The method as claimed in claim 10, comprising coupling the power supply to the body via an electrical cable, and routing the temperature sense signal to a power controller of the power supply via a return path in the electrical cable.

12. The hair styling apparatus as claimed in claim 1, wherein the temperature sensor is electrically insulated from a heater plate of the hair styling heater so as to isolate the temperature sense signal from the secondary side of the transformer.

13. The hair styling apparatus as claimed in claim 1, wherein the power controller is configured to disable the heater drive output responsive to the temperature sense signal meeting or exceeding a reference voltage.

14. The hair styling apparatus as claimed in claim 1, wherein the power supply unit is external to the body of the hair styling apparatus.

15. The hair styling apparatus as claimed in claim 14, wherein the external power supply unit comprises a power switch for turning the hair styling apparatus on and off; wherein the power supply unit is coupled to the body via an electrical cable, and wherein the temperature sense signal is routed to the power controller via a return path in the electrical cable.

16. The hair styling apparatus as claimed in claim 1, wherein the hair styling heater comprises:

a metal sheet or plate;

an oxide layer comprising an oxide of said metal on a surface of said metal sheet or plate; and a heater electrode over said oxide layer, wherein the heater electrode is coupled to the heater drive output.

17. The hair styling apparatus as claimed in claim 1, wherein the temperature sense signal is modulated onto one or more wires carrying power to the hair styling heaters.

18. A power supply unit for a hair styling apparatus, the hair styling apparatus comprising:

a body having at least one arm bearing a hair styling heater for heating hair to be styled; and a temperature sensor arranged to sense a temperature of the hair styling heater and to generate an electrical temperature sense signal that depends on the sensed temperature of the hair styling heater, the power supply unit comprising:

a transformer;

an AC input and a primary side switch coupled to a first side of the transformer;

a heater drive output coupled to a second side of the transformer for powering a said hair styling heater;

a sense input to receive the temperature sense signal; and a power controller coupled to the sense input, wherein the power controller is configured to regulate the output voltage of the heater drive so as to control the temperature of the hair styling heater in multiple steps by adjusting a duty cycle of the primary side switch responsive to a change in the temperature sense signal.

19. The power supply unit as claimed in claim 18, wherein the heater drive output is a low voltage output configured to supply a voltage of less than 100V.

20. The power supply unit as claimed in claim 18, further comprising a primary side switch coupled to the primary winding, wherein the power controller is configured to regulate the heater drive output responsive to the temperature sense signal by controlling switching of the primary side switch coupled to the primary winding.

21. A hair styling apparatus comprising:

a body having at least one arm bearing a hair styling heater, a temperature sensor arranged to sense a temperature of the hair styling heater and to generate an electrical temperature sense signal that depends on the sensed temperature of the hair styling heater;

a power supply unit external to the body, the power supply unit comprising a transformer, AC input coupled to a first side of the transformer to receive mains AC power, and an output coupled to a secondary side of the transformer; and a heater controller circuit coupled to the output of the power supply, the hair styling heater, and to the temperature sense signal, wherein the heater controller circuit is configured to drive the hair styling heater responsive to the temperature sense signal in multiple steps by controlling an input to the first side of the transformer, and wherein the heater controller circuit is located within the power supply unit external to the body of the hair styling apparatus.

22. The hair styling apparatus as claimed in claim 21, wherein the power supply unit is coupled to the body via an electrical cable, and wherein the temperature sense signal is routed to the heater control circuit via a return path in the electrical cable.

23. The hair styling apparatus as claimed in claim 21, wherein the body further comprises a second arm bearing a second hair styling heater, and wherein the hair styling heater and the second hair styling heater are connected in series or parallel.

24. The hair styling apparatus as claimed in claim 23, further comprising a second said temperature sensor arranged to sense a temperature of the second hair styling heater and to generate a second temperature sense signal, wherein the heater controller circuit is further coupled to the second temperature sense signal; and wherein the heater controller circuit is configured to drive the second hair styling heater in response to the second temperature sense signal.

* * * * *